US008438014B2

(12) United States Patent
Morita et al.

(10) Patent No.: US 8,438,014 B2
(45) Date of Patent: May 7, 2013

(54) SEPARATING SPEECH WAVEFORMS INTO PERIODIC AND APERIODIC COMPONENTS, USING ARTIFICIAL WAVEFORM GENERATED FROM PITCH MARKS

(75) Inventors: Masahiro Morita, Kanagawa (JP); Javier Latorre, Tokyo (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/358,702

(22) Filed: Jan. 26, 2012

(65) Prior Publication Data

US 2012/0185244 A1 Jul. 19, 2012

Related U.S. Application Data

(63) Continuation of application No. PCT/JP2009/063663, filed on Jul. 31, 2009.

(51) Int. Cl.
*G10L 11/06* (2006.01)
*G10L 11/04* (2006.01)

(52) U.S. Cl.
USPC ..... 704/208; 704/207; 704/214

(58) Field of Classification Search ..... None
See application file for complete search history.

(56) References Cited

U.S. PATENT DOCUMENTS

| | | | | |
|---|---|---|---|---|
| 5,774,837 | A * | 6/1998 | Yeldener et al. | 704/208 |
| 5,878,388 | A * | 3/1999 | Nishiguchi et al. | 704/214 |
| 5,890,108 | A * | 3/1999 | Yeldener | 704/208 |
| 6,377,916 | B1 * | 4/2002 | Hardwick | 704/208 |
| 6,453,283 | B1 | 9/2002 | Gigi | |
| 6,975,984 | B2 * | 12/2005 | MacAuslan et al. | 704/208 |
| 7,020,615 | B2 * | 3/2006 | Vafin et al. | 704/500 |
| 7,523,032 | B2 * | 4/2009 | Heikkinen et al. | 704/207 |
| 7,778,825 | B2 * | 8/2010 | Kim | 704/208 |
| 7,835,905 | B2 * | 11/2010 | Kim | 704/208 |
| 2007/0288233 | A1 * | 12/2007 | Kim | 704/208 |
| 2008/0109218 | A1 * | 5/2008 | Nurminen et al. | 704/208 |
| 2008/0167863 | A1 * | 7/2008 | Choi et al. | 704/208 |
| 2009/0177474 | A1 | 7/2009 | Morita et al. | |

FOREIGN PATENT DOCUMENTS

| | | |
|---|---|---|
| JP | 2006-113298 | 4/2006 |
| JP | 2009-163121 | 7/2009 |

OTHER PUBLICATIONS

International Search Report for International Application No. PCT/JP2009/063663 mailed on Oct. 20, 2009.
Written Opinion for International Application No. PCT/JP2009/063663 mailed on Oct. 20, 2009.

(Continued)

*Primary Examiner* — Talivaldis Ivars Smits
(74) *Attorney, Agent, or Firm* — Turocy & Watson, LLP

(57) ABSTRACT

According to one embodiment, in a speech processing device, an extractor windows a part of the speech signal and extracts a partial waveform. A calculator performs frequency analysis of the partial waveform to calculate a frequency spectrum. An estimator generates an artificial waveform that is a waveform according to an interval between the pitch marks for each harmonic component having a frequency that is a predetermined multiple of a fundamental frequency of the speech signal and estimates harmonic spectral features representing characteristics of the frequency spectrum of the harmonic component from each of the artificial waveforms. A separator separates the partial waveform into a periodic component produced from periodic vocal-fold vibration as an acoustic source and an aperiodic component produced from aperiodic acoustic sources other than the vocal-fold vibration by using the respective harmonic spectral features and the frequency spectrum of the partial waveform.

12 Claims, 9 Drawing Sheets

OTHER PUBLICATIONS

Jackson, et al. Pitch-Scaled Estimation of Simultaneous Voiced and Turbulence-Noise Components in Speech, IEEE Transactions on Speech and Audio Processing, vol. 9, No. 7, Oct. 2001, pp. 713-726.
Kawahara, et al. Aperiodicity extraction based on linear prediction and temporal axis warping using fundamental frequency information, IEICI Technical Report, NLC2008-38, SP2008-93, Dec 2008.
Yegnanarayana, et al. An Iterative Algorithm for Decomposition of Speech Signals into Periodic and Aperiodic Components, IEEE Transactions on Speech and Audio Processing, vol. 6, No. 1, Jan 1998, pp. 1-11.

* cited by examiner

SEPARATING SPEECH WAVEFORMS INTO PERIODIC AND APERIODIC COMPONENTS, USING ARTIFICIAL WAVEFORM GENERATED FROM PITCH MARKS

CROSS-REFERENCE TO RELATED APPLICATIONS

This application is a continuation of PCT international application Ser. No. PCT/JP2009/063663 filed on Jul. 31, 2009, which designates the United States; the entire contents of which are incorporated herein by reference.

FIELD

Embodiments described herein relate generally to speech processing.

BACKGROUND

There is a known conventional technique for decomposing speech signals into periodic components and aperiodic components that is called pitch-scaled harmonic filtering (PSHF).

For example, "Pitch-Scaled Estimation of Simultaneous Voiced and Turbulence-Noise Components in Speech", IEEE Trans. Speech and Audio Processing, vol. 9, pp. 713-726, October 2001 (P Jackson) discloses a technique of extracting a waveform from periodic waveforms by windowing using an analysis window having a window width that is N times a fundamental period, of performing a discrete Fourier transformation (DFT) on the extracted waveform using the window width as an analysis length, and of separating components into periodic and aperiodic components by using the characteristic that harmonic components appear in synchronization with frequency bins at integral multiples of N.

DETAILED DESCRIPTION

In general, according to one embodiment, in a speech processing device, an extractor windows a part of the speech signal and extracts a partial waveform. A calculator performs frequency analysis of the partial waveform to calculate a frequency spectrum. An estimator generates an artificial waveform that is a waveform according to an interval between the pitch marks for each harmonic component having a frequency that is a predetermined multiple of a fundamental frequency of the speech signal and estimates harmonic spectral features representing characteristics of the frequency spectrum of the harmonic component from each of the artificial waveforms. A separator separates the partial waveform into a periodic component produced from periodic vocal-fold vibration as an acoustic source and an aperiodic component produced from aperiodic acoustic sources other than the vocal-fold vibration by using the respective harmonic spectral features and the frequency spectrum of the partial waveform.

An embodiment of a speech processing device will be described below with reference to the accompanying drawings.

Figure 1:
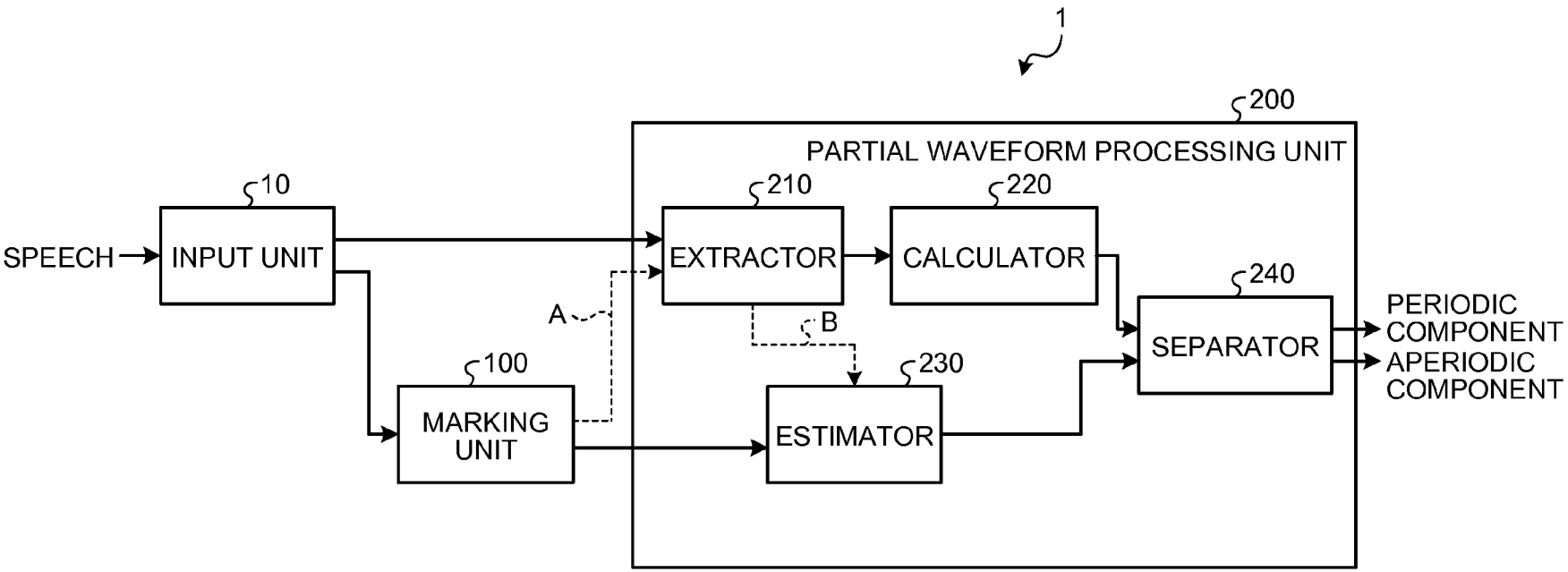
FIG. 1 is a diagram illustrating a speech processing device according to an embodiment.

FIG. 1 is a block diagram illustrating an example of a configuration of a speech processing device 1 according to the embodiment. As illustrated in FIG. 1, the speech processing device 1 includes an input unit 10, a marking unit 100, and a partial waveform processing unit 200. The partial waveform processing unit 200 includes an extractor 210, a calculator 220, an estimator 230, and a separator 240.

The input unit 10 is configured to input speech signals and can be implemented as a file input unit that reads files in which digital speech signals are recorded, for example. Note that the input unit 10 maybe implemented using a microphone or the like. A speech signal refers to a speech waveform obtained by converting air vibration of speech into an electric signal by means of a microphone or the like, but it is not limited to a speech waveform itself and may be any waveform obtained by converting a speech waveform by means of a certain filter or the like. For example, a speech signal may be a prediction residual signal obtained by linear prediction analysis of a speech waveform or a speech signal obtained by applying a bandpass filter to a speech waveform.

Alternatively, the input unit 10 may input, in addition to the speech signal, a fundamental frequency pattern obtained by analyzing a speech signal and an electroglottograph (EGG) signal recorded simultaneously with the speech signal.

The marking unit 100 assigns a pitch mark representing a representative point of a fundamental period to a speech signal input by the input unit 10 for each fundamental period. In the embodiment, the marking unit 100 assigns a pitch mark, as the representative point of a fundamental period, to a glottal closure point that is the point in time when the glottis closes. The marking unit 100 may assign pitch marks to any position in a fundamental period as long as the positions are consistent among the fundamental periods, such as a local peak of the amplitude of a waveform, a point where power concentrates, or a zero crossing. Moreover, a pitch mark need not necessarily be a representative point of a fundamental period and may be equivalent information in another form. For example, since pitch marks can easily be generated from a sequence of fundamental periods or fundamental frequencies with sufficiently high time resolution and accuracy, these can be regarded as information equivalent to representative points of fundamental periods. Note that various methods for assigning pitch marks are known, and the marking unit 100 may use any method to assign the pitch marks.

When a fundamental frequency pattern and an EGG signal are input together with the speech signal by the input unit 10, the marking unit 100 refers to the fundamental frequency pattern and the EGG signal to search for a representative point of a fundamental period and assigns a pitch mark thereto. With this configuration, the accuracy of pitch marking can be improved.

When the separator 240, which will be described later, performs separation into periodic components and aperiodic components only in terms of the effect due to time variation of the pitch, the marking unit 100 assigns the pitch marks by the method described above. However, when the separator 240 also takes the effect due to time variation of the power into account, the marking unit 100 further calculates a power value of the power at a position (hereinafter referred to as a pitch mark position) to which a pitch mark is assigned in each fundamental period.

In the embodiment, the marking unit 100 calculates the power value by using a Hanning window in which the pitch mark position is the window center (specifically, a Hanning window starting from the previous pitch mark position and ending at the next pitch mark position of the pitch mark position for which the power value is to be calculated). Specifically, the marking unit 100 windows the speech signal using the Hanning window to extract a waveform, calculates the power of the extracted waveform, and obtains a square root (i.e., average amplitude) of a value obtained by dividing the calculated power by a power of a window function. Note that the method for calculating the power is not limited to the above, and the marking unit 100 may employ any method as long as a value in which time variation of the power between pitch marks is appropriately reflected can be calculated. For example, the marking unit 100 may employ a method of calculating the amplitude at a local peak near a pitch mark.

Figure 2:
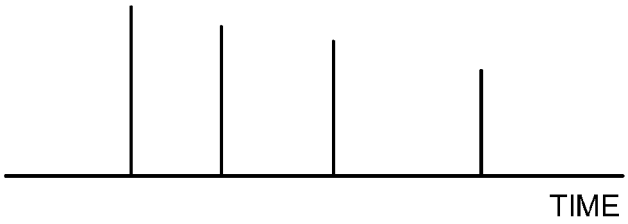
FIG. 2 is a diagram illustrating pitch mark information.

Then, the marking unit 100 outputs pitch mark positions and power values (average amplitudes) at the pitch mark positions as illustrated in FIG. 2 as pitch mark information. When the separator 240 does not take the effect due to the time variation of the power into account, the marking unit 100 outputs only the pitch mark positions as pitch mark information.

The extractor 210 windows a part of the speech signal input by the input unit 10, and extracts a partial waveform that is a speech waveform of the windowed part. A Hanning window, a rectangular window, a Gaussian window or the like may be used for the analysis window (window function) for windowing. In the embodiment, the extractor 210 uses a Hanning window.

Moreover, in the embodiment, the extractor 210 employs a window width that is four times the fundamental period around the center of a partial waveform extracted by the windowing as the window width of the window function. The extractor 210 can obtain the fundamental period from the pitch mark information (see a dashed arrow A in FIG. 1) input from the marking unit 100 or from the fundamental frequency pattern input together with the speech signal by the input unit 10. Note that the window width is desirably about four times the fundamental period in terms of the balance of the trade-off between the frequency resolution and the time resolution in the analysis. However, the window width need not necessarily be in synchronization with the fundamental period, and it may be a fixed value that is about 2 to 10 times the fundamental period.

The calculator 220 performs frequency analysis of the partial waveform extracted by the extractor 210 to calculate a frequency spectrum. Specifically, the calculator 220 calculates a DFT spectrum by performing a discrete Fourier transformation on the partial waveform extracted by the extractor 210.

In the embodiment, the calculator 220 performs a discrete Fourier transformation using an analysis length that is four times the fundamental period and that is the same length as the window width used for windowing by the extractor 210. However, the analysis length may have a different length as long as it is not shorter than the partial wavelength. If the analysis length is longer than the partial waveform, the calculator 220 embeds "0" at a portion in excess of the length of the partial waveform and then performs a discrete Fourier transformation.

The estimator 230 generates an artificial waveform that is a waveform according to an interval between the pitch marks for each harmonic component having a frequency that is a predetermined multiple of the fundamental frequency of the speech signal, and the estimator 230 then estimates harmonic spectral features representing characteristics of a frequency spectrum of the harmonic component from each of the generated artificial waveforms. As a result, the spectral features of each harmonic component included in the partial waveform (see the dashed arrow B in FIG. 1) extracted by the extractor 210 are estimated.

Note that the harmonic spectral features represent distribution of the amplitude in a DFT spectrum of a harmonic component and the relation of the phase between DFT bins, and the harmonic spectral features include the effect due to time variation of the pitch and the power in the partial waveform as well as the effect due to windowing.

Specifically, the amplitude of each harmonic component spreads in the frequency direction as a result of time variation of the pitch and the power and windowing, and the phase thereof is also affected, but the degree the phase is affected varies with each harmonic component. For example, a harmonic of a higher frequency is more likely to be affected by time variation. Accordingly, the estimator 230 estimates the distribution of the amplitude in the DFT spectrum or the relation of the phase between DFT bins after being affected by the time variation of the pitch and the power and windowing for each harmonic component. Details of the estimator 230 will be described later.

The separator 240 separates the partial waveform extracted by the extractor 210 into a periodic component produced from periodic vocal-fold vibration as an acoustic source and an aperiodic component produced from aperiodic acoustic sources other than vocal-fold vibration by using the respective harmonic spectral features estimated by the estimator 230 and the DFT spectrum of the partial waveform calculated by the calculator 220. Note that the periodic component and the aperiodic component obtained by the separation refer to a speech waveform of the periodic component and a speech waveform of the aperiodic component, respectively, in the embodiment. Details of the separator 240 will be described later.

Figure 3:
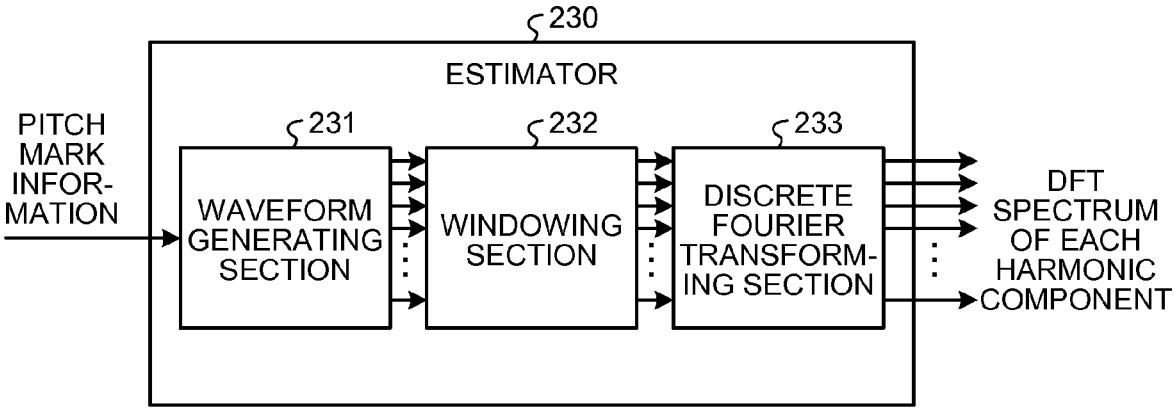
FIG. 3 is a diagram illustrating an estimator of the embodiment.

FIG. 3 is a block diagram illustrating an example of a configuration of the estimator 230 according to the embodiment. As illustrated in FIG. 3, the estimator 230 includes a waveform generating section 231, a windowing section 232 and a discrete Fourier transforming section 233.

The waveform generating section 231 generates an artificial waveform by using the pitch mark information (the pitch mark positions and the power values at the pitch mark positions) input from the marking unit 100. In the embodiment, the waveform generating section 231 generates an artificial waveform expressed by equation (1) for each harmonic component.

$$f_n(t)=g_n(t)\cdot\cos\left(\int_{t_0}^{t}\omega_n(t)dt+a_n\right) \quad (1)$$

In equation (1), a function and a parameter with a subscript n represent those of an n-th harmonic component (a harmonic component having a frequency that is an n multiple of the fundamental frequency). In addition, $g_n(t)$ represents a time-varying amplitude, $\omega_n(t)$ represents each time-varying frequency, and $\alpha_n$ represents an initial phase. Moreover, $t_0$ represents a starting time of an artificial waveform. Note that any function may be used for $g_n(t)$ and $\omega_n(t)$. However, since it can be assumed that variation in the power and variation in the pitch can be linearly approximated within a zone that is about several times the fundamental period, $g_n(t)$ and $\omega_n(t)$ are expressed by linear functions in the embodiment. In addition, a function that is common for all harmonic components is used for $g_n(t)$ in the embodiment.

Next, methods for calculating a coefficient of $g_n(t)$, a coefficient of $\omega_n(t)$, and $\alpha_n$ will be described. First, the position and the average amplitude of an i-th pitch mark in the pitch mark information input to the waveform generating section 231 are represented by $t_i$ and $p_i$, respectively, and $i_{min}$-th to $i_{max}$-th pitch marks are included within the range to be analyzed. In addition, the coefficient of $g_n(t)$ can be obtained by minimizing a square error from a sequence of the average amplitude $(t_i, p_i)$ $(i_{min} \leqq i \leqq i_{max})$ i.e., by minimizing an evaluation function expressed by equation (2).

$$ERR_g = \sum_{i=i_{min}}^{i_{max}} \{w_g(t_i) \cdot (g_n(t_i) - p_i)^2\} \tag{2}$$

In equation (2), $w_g(t)$ represents a function for weighting an error evaluation, and it can make the weight of a center position of analysis heavier and the weight at a position farther from the center lighter, for example. Note that a coefficient minimizing the evaluation function expressed by equation (2) can be easily obtained in an analytical manner when $g_n(t)$ is a linear function and can be obtained by using a known optimizing technique even when the function cannot be obtained in an analytical manner.

Next, the coefficient of $\omega_n(t)$ can be obtained by minimizing an evaluation function expressed by equation (3).

$$ERR_\omega = \sum_{i=i_{min}}^{i_{max}-1} \left\{ w_\omega(t_i) \cdot \left( \int_{t_i}^{t_{i+1}} \omega_n(t)\,dt - 2\pi \cdot n \right)^2 \right\} \tag{3}$$

In equation (3), $w_\omega(t)$ represents a function for weighting an error evaluation (the weighting performed similarly to that of $w_g(t)$), and it may be the same function as or a different function from $w_g(t)$. A function that makes the phase variation of the artificial wave between pitch marks as close as possible to an n multiple of $2\pi$ is obtained by minimizing the evaluation function expressed by equation (3). This means that the phase of a first harmonic component varies by one period between pitch marks and the phase of a second harmonic component varies by two periods between pitch marks. Note that a coefficient minimizing the evaluation function expressed by equation (3) can also be obtained in an analytical manner when $\omega_n(t)$ is a linear function, and it can be obtained by using a known optimizing technique even when the function cannot be obtained in an analytical manner.

Next, $\alpha_n$ is obtained by equation (4), where the time of a pitch mark that is nearest to the center position of analysis is $t_{i_mid}$.

$$\alpha_n = 2k\pi - \int_0^{t_{i_mid}} \omega_n(t)\,dt \tag{4}$$

In the equation, k represents an arbitrary integer of a value that minimizes the absolute value of $\alpha_n$. As a result of obtaining $\alpha_n$, the artificial waveform has zero phase at the pitch mark that is nearest to the center.

Figure 4:
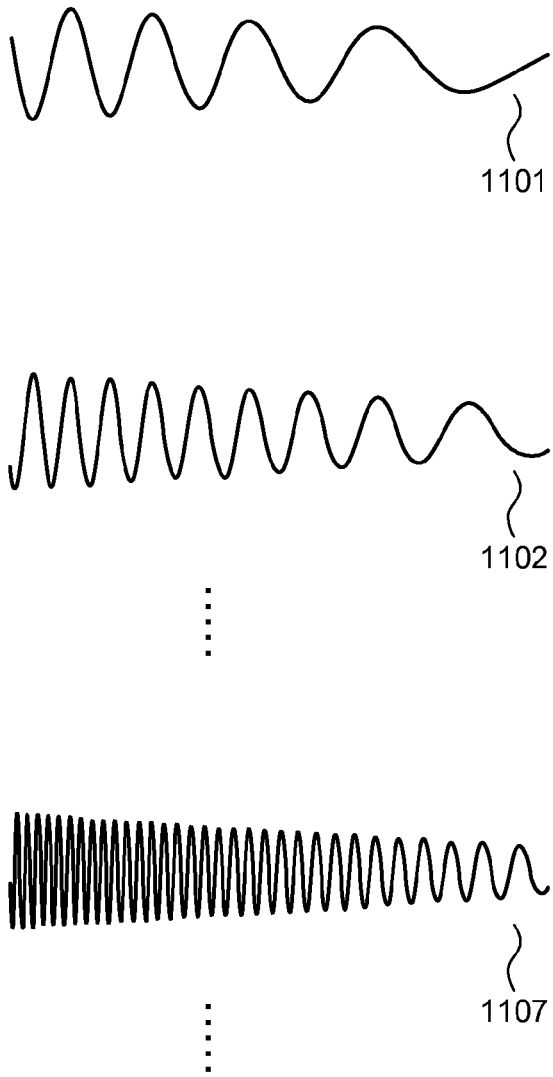
FIG. 4 is a diagram illustrating artificial waveforms.

FIG. 4 is a diagram illustrating examples of artificial waveforms generated by the waveform generating section 231. Artificial waveforms 1101, 1102 and 1107 represent artificial waveforms generated for first, second and seventh harmonic components, respectively. Note that the artificial waveform 1101 has a period corresponding to the pitch mark interval, the artificial waveform 1102 has a period corresponding to ½ of the pitch mark interval, and the artificial waveform 1107 has a period corresponding to ⅐ of the pitch mark interval.

Figure 5:
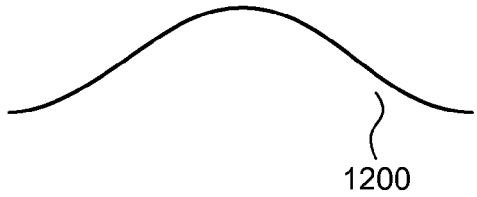
FIG. 5 is a diagram illustrating a Hanning window.

Referring back to FIG. 3, the windowing section 232 performs windowing of each of the artificial waveforms generated by the waveform generating section 231 by using an analysis window having the same length as that for the extractor 210. In the embodiment, the windowing section 232 windows the artificial waveforms 1101, 1102, 1107 and so on by using a Hanning window 1200 having a window width of four times the fundamental period around the center of a partial waveform, as illustrated in FIG. 5.

Figure 6:
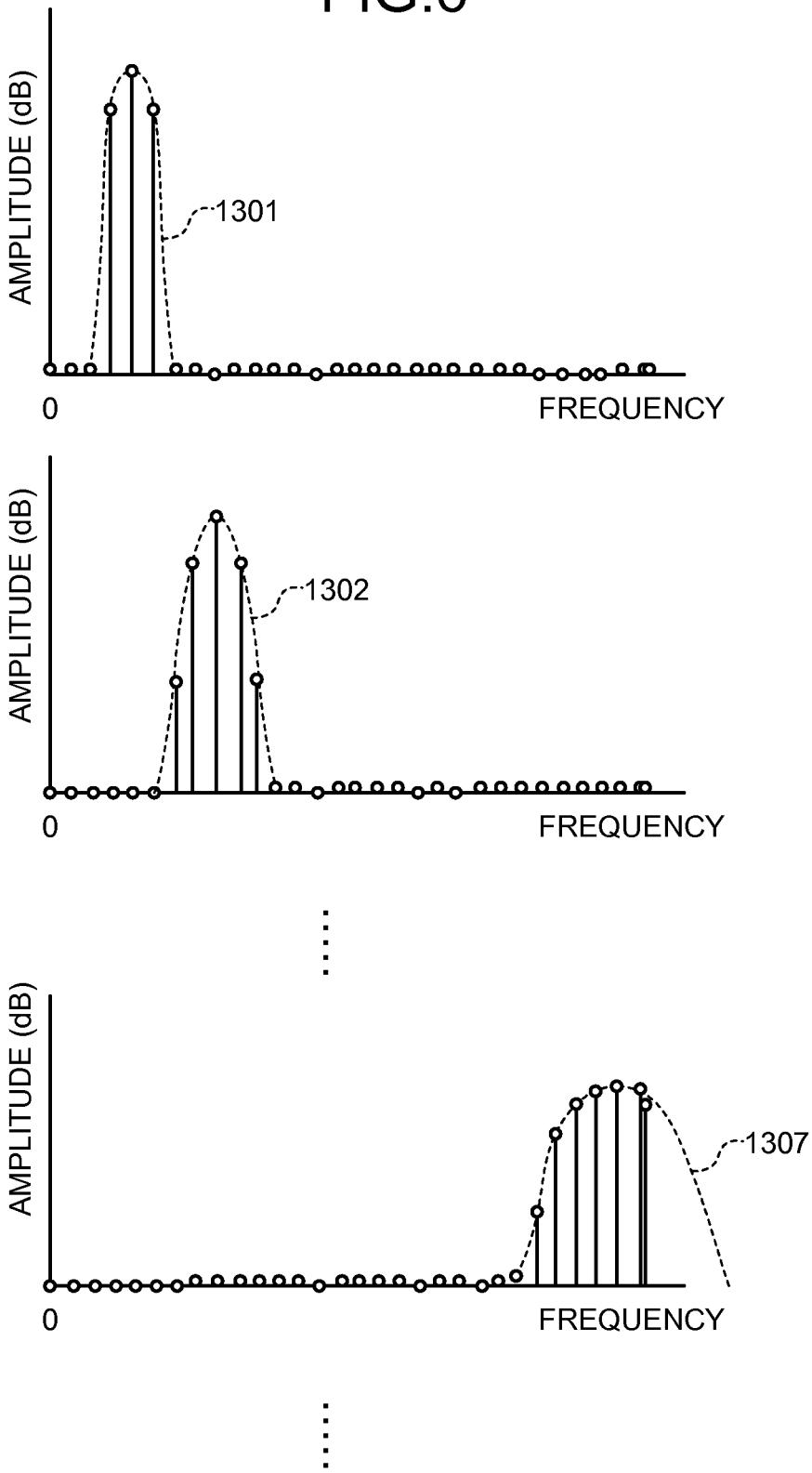
FIG. 6 illustrates graphs of DFT spectra.

The discrete Fourier transforming section 233 performs a discrete Fourier transformation on each of the artificial waveforms windowed by the windowing section 232 to calculate a DFT spectrum representing harmonic spectral features and outputs the DFT spectrum. FIG. 6 illustrates graphs of examples of the DFT spectra calculated by the discrete Fourier transforming section 233. DFT spectra 1301, 1302 and 1307 represent DFT spectra of the first, second and seventh harmonic components, respectively.

Figure 7:
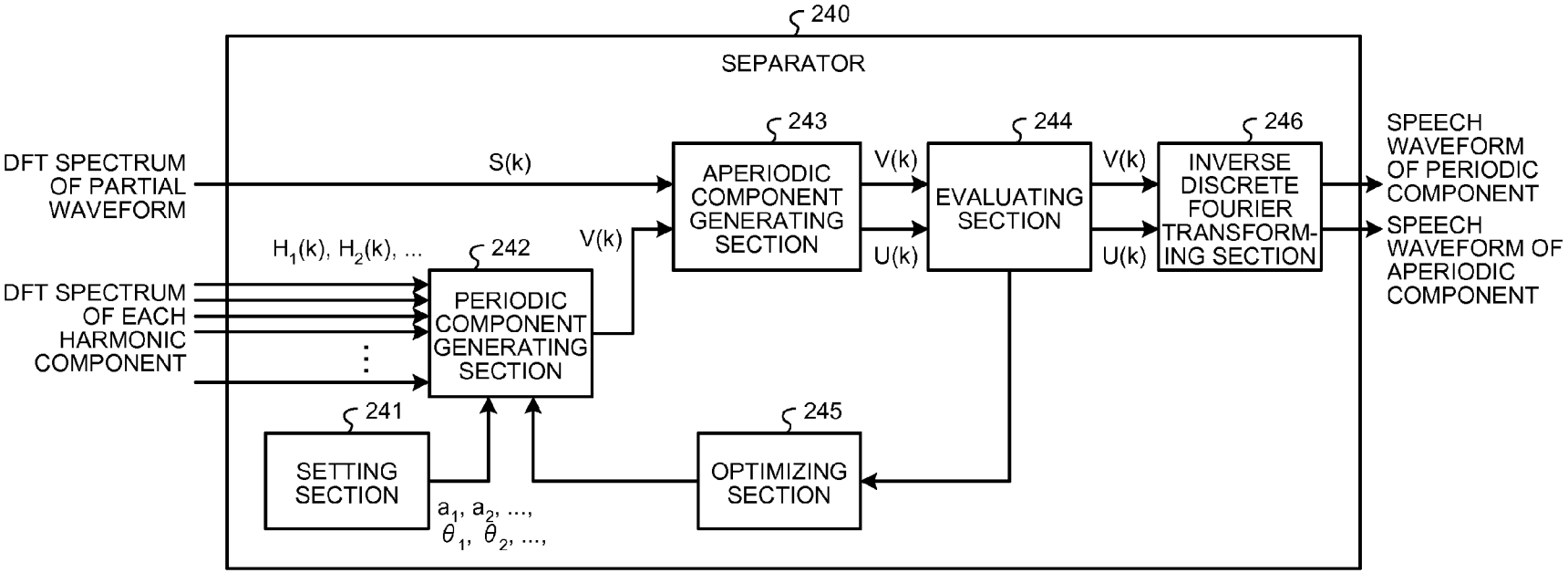
FIG. 7 is a diagram illustrating a separator of the embodiment.

FIG. 7 is a block diagram illustrating an example of a configuration of the separator 240 according to the embodiment. As illustrated in FIG. 7, the separator 240 includes a setting section 241, a periodic component generating section 242, an aperiodic component generating section 243, an evaluating section 244, an optimizing section 245, and an inverse discrete Fourier transforming section 246.

The separator 240 has a DFT spectrum for each harmonic component input from the estimator 230 (see FIG. 6) as a base, and it represents a frequency spectrum of the periodic component by a linear sum thereof. Specifically, when a DFT spectrum of an i-th harmonic component is represented by $H_i(k)$ (k is a bin number of the DFT), the frequency spectrum V(k) of the periodic component is expressed as in equation (5).

$$V(k) = \sum_i \{a_i \cdot \exp(j\theta_i) \cdot H_i(k)\} \tag{5}$$

In the equation, $a_i$ represents a weight for each base. In addition, $\exp(j\theta_i)$ represents turning of the phase by $\theta_i$, and it is used for adjusting the deviation between an actual harmonic component and the phase of $H_i(k)$. The separator 240 obtains parameters $(a_1, a_2, \ldots, \theta_1, \theta_2, \ldots)$ so as to appropriately, fit the frequency spectrum V(k) of the periodic component obtained by equation (5) to the DFT spectrum S(k) of the partial waveform calculated by the calculator 220. The separator 240 then extracts the frequency spectrum V(k) of the periodic component from the DFT spectrum S(k) of the partial waveform, and the remaining component represents a frequency spectrum U(k) of the aperiodic component.

The setting section 241 sets initial values of parameters used for separating the partial waveform into the frequency spectrum of the periodic component and the frequency spectrum of the aperiodic component. Specifically, the setting section 241 sets initial values for $a_i$ and $\theta_i$. For example, the setting section 241 sets to $a_i$ a ratio ($|S(k_i)|/|H_i(k_i)|$) of the amplitude $|S(k_i)|$ to the amplitude $|H_i(k_i)|$ of the $k_i$-th bin where the number of a DFT bin corresponding to the center frequency of the i-th harmonic component is represented by $k_i$. Note that $k_i$ corresponds to 4·i when the analysis length for the DFT is four times the fundamental period. In addition, the setting section 241 sets the phase of S(k) of the $k_i$-th bin to $\theta_i$, for example.

The periodic component generating section 242 generates the frequency spectrum of the periodic component by calculating a linear sum of the harmonic spectral features estimated by the estimator 230. Specifically, the periodic component generating section 242 assigns the DFT spectrum $H_i(k)$ for each harmonic component estimated by the estimator 230 and the values of $a_i$ and $\theta_i$ set by the setting section 241 in equation (5) to generate the frequency spectrum V(k) of the periodic component.

Figure 8:
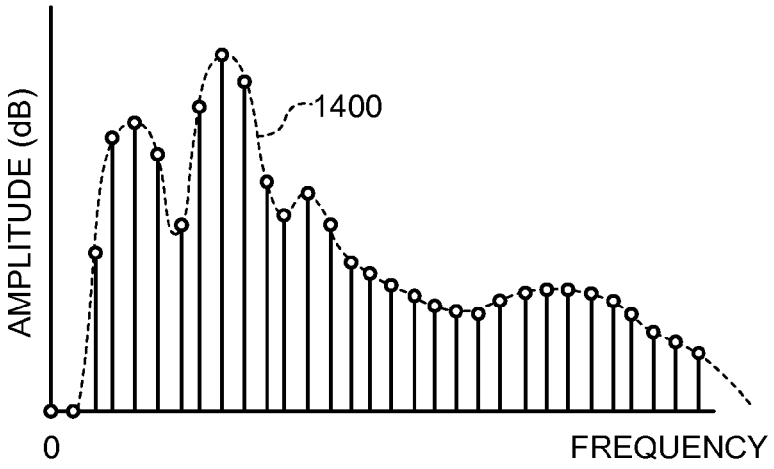
FIG. 8 is a graph illustrating a frequency spectrum of periodic components.

FIG. 8 is a graph illustrating an example of the frequency spectrum of the periodic components generated by the periodic component generating section 242. In the example illustrated in FIG. 8, a frequency spectrum 1400 of the periodic component has the DFT spectra of the harmonic components illustrated in FIG. 6 as bases and is a linear sum thereof.

Referring back to FIG. 7, the aperiodic component generating section 243 generates the frequency spectrum of the aperiodic component by using the DFT spectrum of the partial waveform calculated by the calculator 220 and the frequency spectrum of the periodic component generated by the periodic component generating section 242. Specifically, the aperiodic component generating section 243 subtracts the frequency spectrum V(k) of the periodic component generated by the periodic component generating section 242 from the DFT spectrum S(k) of the partial waveform calculated by the calculator 220 to generate the frequency spectrum U(k) of the aperiodic component. Thus, the frequency spectrum U(k) of the aperiodic component is expressed as in equation (6). Note that the subtraction by the aperiodic component generating section 243 is performed on a complex spectrum range, and the phase is also taken into account in addition to the amplitude.

$$U(k)=S(k)-V(k) \tag{6}$$

The evaluating section 244 evaluates the degree of the appropriateness of the separation between the frequency spectrum of the periodic component generated by the periodic component generating section 242 and the frequency spectrum of the aperiodic component generated by the aperiodic component generating section 243. In the embodiment, the evaluating section 244 uses the power of the frequency spectrum U(k) of the aperiodic component as one evaluation measure indicating the appropriateness of the separation. Specifically, the evaluation measure is represented by Cost_uPwr and expressed as in equation (7).

$$\text{Cost_uPwr} = \sum_k |U(k)|^2 \tag{7}$$

The evaluation measure expressed by equation (7) is based on the idea that the power of the frequency spectrum U(k) of the aperiodic component is small if the frequency spectrum V(k) of the periodic component can be appropriately fitted to the DFT spectrum S(k) of the partial waveform. The result of separation is evaluated as being more appropriate as the value of Cost_uPwr is smaller.

The evaluating section 244 then determines whether or not the evaluation measure expressed by equation (7) is convergent. Specifically, it is determined whether or not the difference between a calculated evaluation value and a previous evaluation value (or the ratio of the difference to the evaluation value) is smaller than a preset threshold.

If the evaluating section 244 determines that the evaluation measure is not convergent, the optimizing section 245 optimizes the values of the parameters used for separating the partial waveform into the frequency spectrum of the periodic component and the frequency spectrum of the aperiodic component. For example, when Cost_uPwr of equation (7) is used as the evaluation measure, the optimizing section 245 solves equations (8) and (9), in which the partial differentials of Cost_uPwr with respect to $a_i$ and $\theta_i$ are 0, as simultaneous equations to optimize $a_i$ and $\theta_i$ to values that most appropriately improve the evaluation value.

$$\frac{\partial \text{Cost_uPwr}}{\partial a_i} = 0 \tag{8}$$

$$\frac{\partial \text{Cost_uPwr}}{\partial \theta_i} = 0 \tag{9}$$

Note that, depending on the function expressing the evaluation measure, parameters that improve the evaluation value cannot always be obtained in the analytic manner as described above. In such cases, parameters that improve the evaluation value can be obtained by using a known optimizing method such as the gradient method, Newton's method, or the conjugate gradient method.

If the evaluating section 244 determines that the evaluation measure is convergent, the inverse discrete Fourier transforming section 246 performs an inverse discrete Fourier transformation on the frequency spectra of the periodic component and the aperiodic component to generate speech waveforms of the periodic component and the aperiodic component, respectively. However, when the output from the separator 240 is the DFT spectrum instead of a speech waveform, the inverse Fourier transforming section 246 is not necessary.

Figure 9:
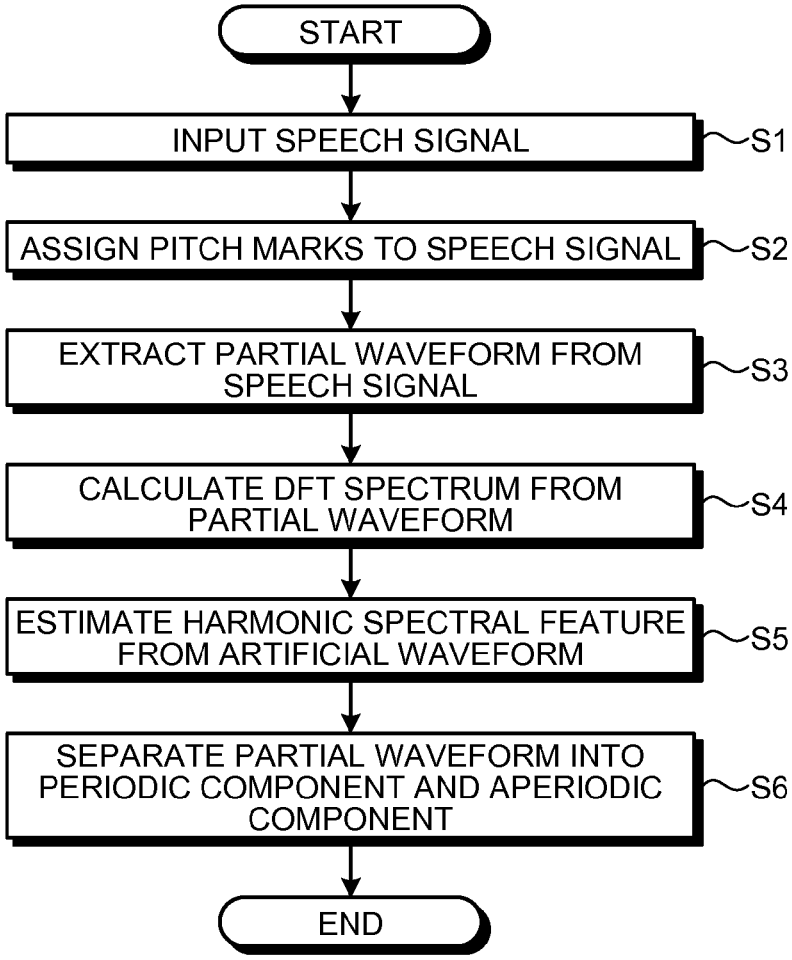
FIG. 9 is a flowchart illustrating speech processing of the embodiment.

FIG. 9 is a flowchart illustrating an example of speech processing performed by the speech processing device 1 according to the embodiment.

In step S1, the input unit 10 inputs a speech signal.

In step S2, the marking unit 100 assigns a pitch mark representing a representative point in a fundamental period to the speech signal input by the input unit 10 for each fundamental period.

In step S3, the extractor 210 windows a part of the speech signal input by the input unit 10, and extracts a partial waveform that is a speech waveform of the windowed part.

In step S4, the calculator 220 performs a discrete Fourier transformation on the partial waveform extracted by the extractor 210 to calculate a DFT spectrum.

In step S5, the estimator 230 generates an artificial waveform that is a waveform according to an interval between the pitch marks for each harmonic component, and it estimates the harmonic spectral features representing characteristics of the frequency spectrum of the harmonic components from each of the generated artificial waveforms.

In step S6, the separator 240 separates the partial waveform extracted by the extractor 210 into the periodic component and the aperiodic component by using the respective harmonic spectral features estimated by the estimator 230 and the DFT spectrum of the partial waveform calculated by the calculator 220.

Figure 10:
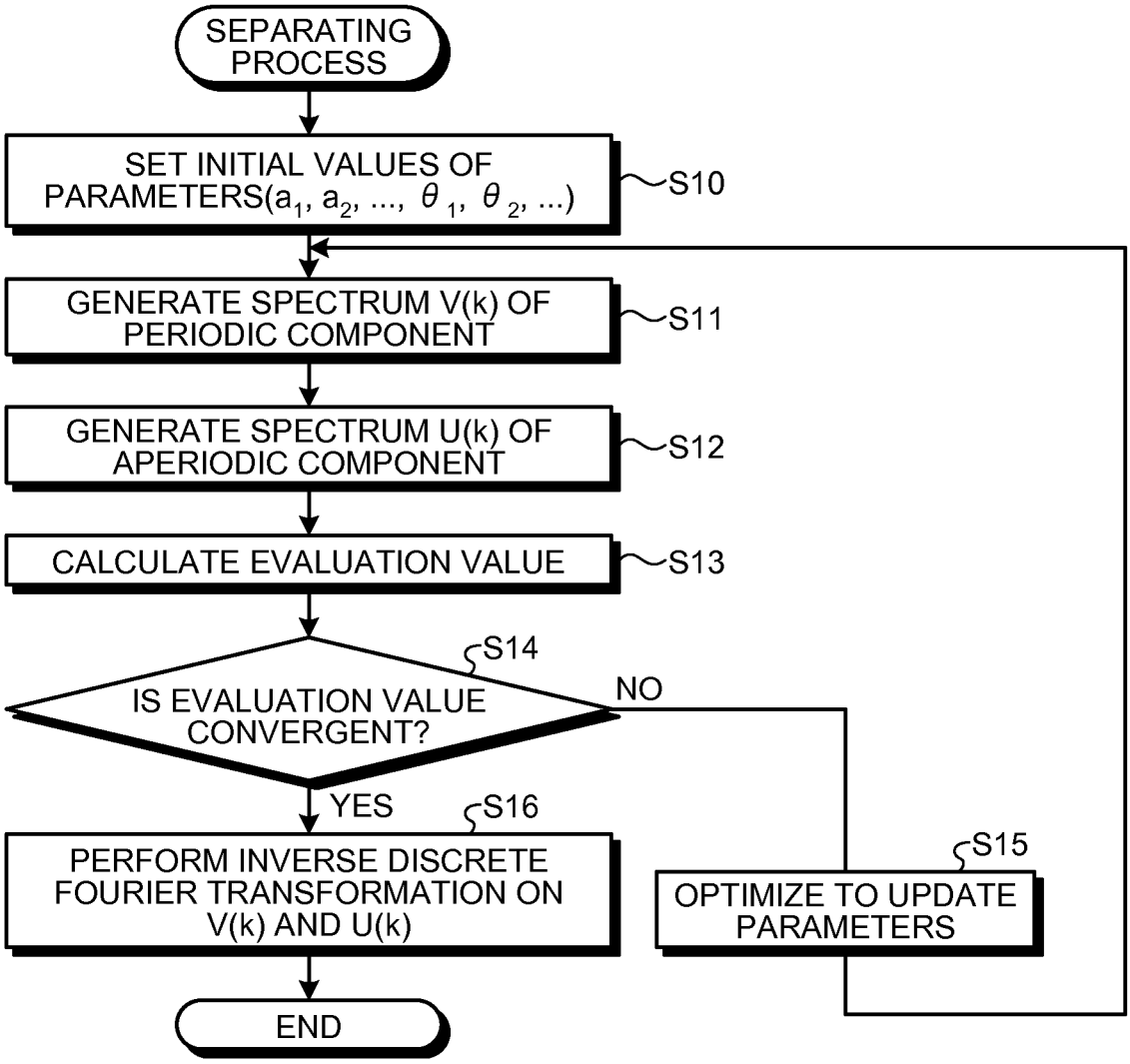
FIG. 10 is a flowchart illustrating a separating process of the embodiment.

FIG. 10 is a flowchart illustrating an example of a separating process performed by the separator 240 according to the embodiment.

In step S10, the setting section 241 sets initial values of the parameters ($a_i$, $\theta_i$) used for separating the partial waveform into the frequency spectrum of the periodic component and the frequency spectrum of the aperiodic component.

In step S11, the periodic component generating section 242 generates the frequency spectrum V(k) of the periodic component by calculating linear sums of the respective harmonic spectral features estimated by the estimator 230.

In step S12, the aperiodic component generating section 243 generates the frequency spectrum U(k) of the aperiodic component by subtracting the frequency spectrum V(k) of the periodic component generated by the periodic component generating section 242 from the DFT spectrum S(k) of the partial waveform calculated by the calculator 220.

In step S13, the evaluating section 244 calculates an evaluation value for evaluating the degree of appropriateness of the separation between the frequency spectrum of the periodic component generated by the periodic component generating section 242 and the frequency spectrum of the aperiodic component generated by the aperiodic component generating section 243.

In step S14, the evaluating section 244 checks the evaluation value calculated in step S13 to determine whether or not the evaluation value is convergent. Specifically, the evaluating section 244 determines whether or not the difference between a calculated evaluation value and a previous evaluation value (or a ratio of the difference to the evaluation value) is smaller than a predetermined threshold. Then, the evaluating section 244 proceeds to step S16 if the evaluation value is convergent (Yes in step S14), or the evaluating section 244 proceeds to step S15 if the evaluation value is not convergent (No in step S14).

In step S15, the optimizing section 245 updates to optimize the values of the parameters to be used for separating the partial waveform into the frequency spectrum of the periodic component and the frequency spectrum of the aperiodic component on the basis of the evaluation by the evaluating section 244.

In step S16, the inverse discrete Fourier transforming section 246 performs an inverse discrete Fourier transformation on the frequency spectra of the periodic component and the aperiodic component to generate speech waveforms of the periodic component and the aperiodic component, respectively.

As described above, according to the embodiment, harmonic spectral features are estimated from respective artificial waveforms that are waveforms according to the pitch mark interval and the power, and a partial waveform is separated into a periodic component and an aperiodic component by using the respective harmonic spectral features and the frequency spectrum of the partial waveform. Therefore, according to the embodiment, the separation into the periodic component and the aperiodic component is performed taking into account the effect due to time variation of the pitch and the power on the harmonic components, and thus even a speech signal with time varying pitch and power can be separated into a periodic component and an aperiodic component with high accuracy.

Note that the speech processing device according to the embodiment includes a controller such as a CPU, a storage unit such as a ROM and a RAM, an external storage device such as a HDD and a removable drive device, a display device such as a display, and an input device such as a keyboard and a mouse. A hardware configuration utilizing a common computer system may be used.

Modified Example 1

In the embodiment described above, an example is described in which the speech waveform of the periodic component and the speech waveform of the aperiodic component obtained by separating the partial waveform are output. In practice, however, a continuous speech waveform that is a speech waveform having a certain length is often separated into a speech waveform of a periodic component and a speech waveform of an aperiodic component. In the modified example 1, therefore, a description is given of an example in which a continuous speech waveform is separated into a speech waveform of a periodic component and a speech waveform of an aperiodic component by superposing the speech waveform of the periodic component and the speech waveform of the aperiodic component, respectively, obtained by separating partial waveforms at respective times constituting the continuous speech waveform, and the speech waveform of the periodic component and the speech waveform of the aperiodic component are output.

Figure 11:
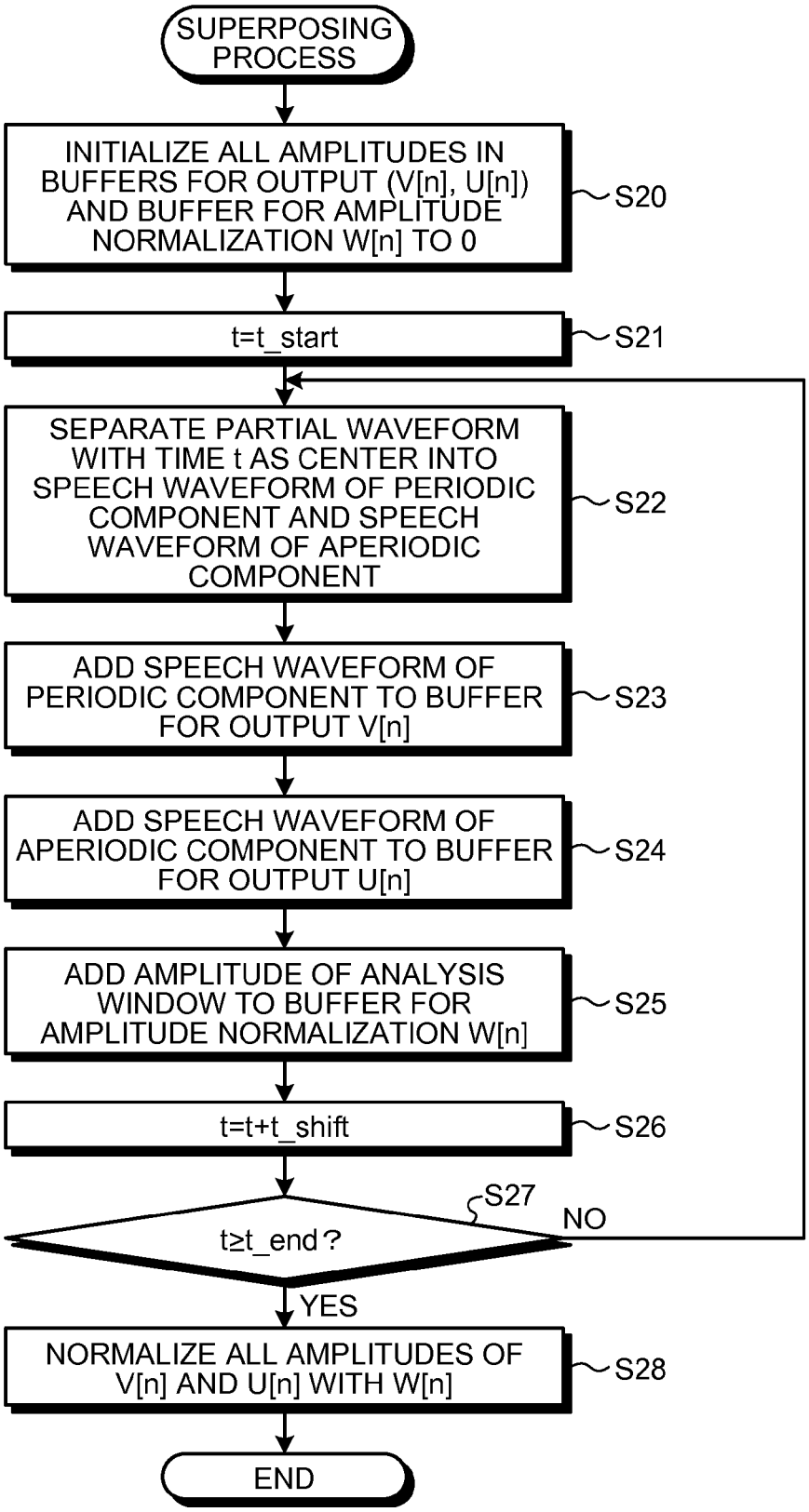
FIG. 11 is a flowchart illustrating a superposing process of a modified example.

FIG. 11 is a flowchart illustrating an example of a superposing process performed in the speech processing device 1 according to the modified example 1.

In step S20, the partial waveform processing unit 200 initializes to 0 all of the amplitudes in a buffer V[n] for outputting a speech waveform of the periodic component of a continuous speech waveform, a buffer U[n] for outputting a speech waveform of the aperiodic component of the continuous speed waveform, and a buffer W[n] for amplitude normalization. Note that the buffers are prepared in a storage unit that is not illustrated.

In step S21, the partial waveform processing unit 200 sets an analysis time t to time t_start at an analysis starting position.

In step S22, the separator 240 performs a process of separating a partial waveform having the center at analysis time t to separate the partial waveform into a speech waveform of the periodic component and a speech waveform of the aperiodic component.

In step S23, the partial waveform processing unit 200 adds the speech waveform of the periodic component obtained by the separation to the amplitude at the corresponding time in the buffer V[n].

In step S24, the partial waveform processing unit 200 adds the speech waveform of the aperiodic component obtained by the separation to the amplitude at the corresponding time in the buffer U[n].

In step S25, the partial waveform processing unit 200 adds the amplitude of an analysis window to the amplitude at the corresponding time in the buffer W[n].

In step S26, the partial waveform processing unit 200 adds time t_shift, which is a shift width of an analysis, to the analysis time t. The accuracy of an analysis is higher as t_shift becomes as small as possible, but t_shift may be arbitrarily set by trade-off with the processing time as long as t_shift is up to about the fundamental period.

In step S27, the partial waveform processing unit 200 determines whether or not the analysis time t has reached time t_end at an analysis end position, and proceeds to step S28 if the time t_end has been reached (Yes in step S27) or proceeds to step S22 if the time tend has not been reached (No in step S27).

In step S28, the partial waveform processing unit 200 normalizes all of the amplitudes in the buffers V[n] and U[n] by dividing the amplitudes by the amplitude at the corresponding time in the buffer W[n]. Specifically, the partial waveform processing unit 200 superposes the speech waveforms of the periodic component and the speech waveforms of the aperiodic component obtained at the respective times to separate the continuous speech waveform into the speech waveform of the periodic component and the speech waveform of the aperiodic component, and outputs the speech waveforms.

As described above, according to the modified example 1, a continuous speech waveform can be separated into a speech waveform of a periodic component and a speech waveform of an aperiodic component.

Modified Example 2

In the embodiment described above, an example in which the power of the frequency spectrum of the aperiodic component is used as the evaluation measure of the evaluating section 244 is described. If, however, the evaluation measure is used for separation of the frequency spectrum of the aperiodic component, a deep trough may be caused at a position of a harmonic component (a position of an integral multiple of the fundamental frequency) in the frequency spectrum of the aperiodic component obtained by the separation, and the spectrum may become unnatural.

This is because the periodic component generating section 242 may excessively fit peaks of the DFT spectrum $H_i(k)$ for each harmonic component estimated by the estimator 230 to peaks found at positions of the harmonic components of the DFT spectrum S(k) of the partial waveform. Since some aperiodic components are also included at the positions of the harmonic components in an actual speech waveform, such behavior is not really desired.

Therefore, in the modified example 2, a method for reflecting characteristics relating to the frequency spectrum of an aperiodic component in the evaluation measure so as to improve such behavior will be described.

In general, the power of the frequency spectrum of the aperiodic component varies smoothly in the frequency axis direction and is less likely to change rapidly. Therefore, in the modified example 2, an index representing the smoothness of the power of the frequency spectrum of the aperiodic component as expressed by equation (10) is introduced as an evaluation measure for the evaluating section 244.

$$\text{Cost_uPwrFlatness} = \sum_k \left( |U(k)| - \frac{1}{W} \sum_{1=k-W/2}^{k+W/2} |U(1)| \right)^2 \tag{10}$$

In the equation, U(k) represents the frequency spectrum of the aperiodic component, W represents the window width of the moving average, and W is set to a value of about 5 to 10, for example. Thus, the index expressed by equation (10) represents local distribution from the moving average of the amplitude of the frequency spectrum of the aperiodic component, and it is a small value when the power of the frequency spectrum of the aperiodic component varies smoothly in the frequency axis direction or a large value when the power changes abruptly.

Note that the index expressed by equation (10) alone or in combination with the evaluation measure expressed by equation (7) may be used as the evaluation measure for the evaluating section 244. For example, a value obtained by weighting and adding the evaluation measure expressed by equation (7) and the index expressed by equation (10) may be used as expressed by equation (11).

$$\text{Cost} = \text{Cost_}u\text{Pwr}\cdot(1-w) + \text{Cost_}u\text{PwrFlatness}\cdot w \tag{11}$$

In the equation, w can be set within a range of 0 to 1, and is set to 0.5, for example. If such an evaluation measure is used for the separation, overfitting to peaks at positions of the harmonics can be prevented to some extent, and an aperiodic component having a relatively smooth and natural shape can be obtained.

Note that an index representing the smoothness of the power of the spectrum of the aperiodic component is not limited to equation (10), and other indices may be used. For example, a value obtained by applying a low pass filter to U(k) instead of the term representing the local moving average in equation (10) may be used, or $U_h(k)$ obtained by applying a high pass filter to U(k) as expressed by an equation (12) may be used.

$$\text{Cost_uPwrFlatness2} = \sum_k |U_h(k)|^2 \tag{12}$$

Modified Example 3

Although an example is described in the modified example 1 in which an index representing the smoothness of the power of the frequency spectrum of the aperiodic component is introduced as an index representing a characteristic relating to the frequency spectrum of the aperiodic component, other indices may be used.

Therefore, in the modified example 3, an example in which an index representing the degree of randomness of the phase in the frequency spectrum of the aperiodic component will be described since such a phase is generally random.

When the phase is random, the result of adding components of the bins of the DFT spectrum in the complex spectrum range becomes close to 0, and thus an index as expressed by equation (13) can be used as the evaluation measure for the evaluating section 244.

$$\text{Cost_uPhaseRandomness} = \sum_b \left( \sum_{k=start(b)}^{end(b)} U(k) \right)^2 \tag{13}$$

In equation (13), b represents an ID of each of a plurality of bands into which the frequency band is divided, start(b) represents an ID of a DFT bin corresponding to a starting point (lowest frequency) of the band b, and end(b) represents an ID of a DFT bin corresponding to an end point (maximum frequency) of the band b. In other words, the index expressed by equation (13) represents a square sum for all bands of values resulting from calculating the addition of components of the bins in the DFT spectrum for each frequency band in the complex spectrum range. Note that the width of each band is preferably such a width that each band includes one harmonic component, i.e., about a width of the fundamental frequency. With the index expressed by equation (13), it is considered that the value moves close to 0 when the phase of the aperiodic component is random and the value moves away from 0 when there is a certain correlation between phases.

Note that the index expressed by equation (13) may be used alone as the evaluation measure for the evaluating section 244, or a weighted sum of the index and an index relating to the power of the DFT spectrum of the aperiodic component or the smoothness of the power may be used as the evaluation value, similarly to the modified example 2.

If such an evaluation measure is used for the separation, overfitting to peaks at positions of the harmonics can be prevented to some extent, and an aperiodic component having random phases can be obtained, similarly to the modified example 2.

Note that an index representing the randomness of the phases in the frequency spectrum of the aperiodic component is not limited to equation (13), and other indices may be used. For example, an inverse of a group delay dispersion may be used as an index by utilizing the characteristic that the dispersion of "group delays" obtained by differentiating the phase spectrum by the frequency is larger as the phases become more random.

Modified Example 4

In the embodiment described above, the aperiodicity produced by time variation of the pitch and the power can be handled appropriately. However, the aperiodicity produced by time variation of a vocal tract shape is not taken into account. Accordingly, a periodic component produced from vocal-fold vibration may leak a lot into an aperiodic component at a point such as a phoneme boundary where the vocal tract shape changes abruptly and the spectrum envelope (outline of the spectrum) thus changes a lot in the embodiment described above.

In the modified example 4, therefore, a description is given of an example in which separation into a periodic component and an aperiodic component is performed by using a speech signal resulting from applying whitening so as to remove the spectrum envelope (outline of the spectrum of the speech signal) so as to address such problems.

Figure 12:
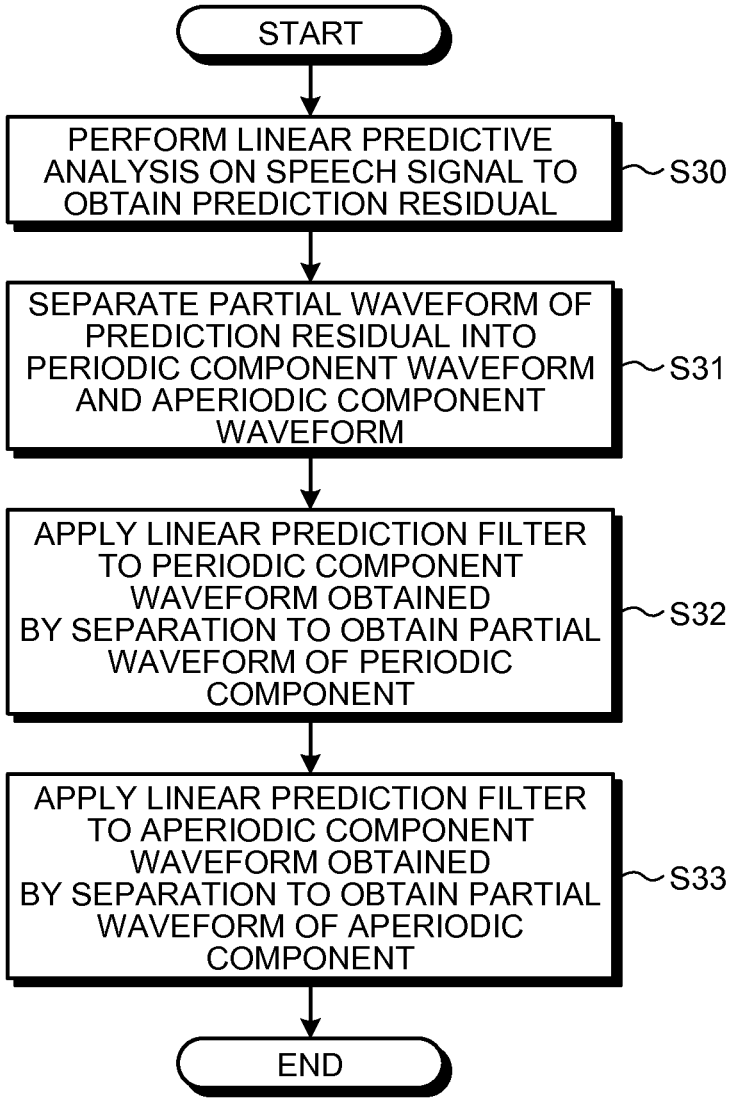
FIG. 12 is a flowchart illustrating speech processing of a modified example.

FIG. 12 is a flowchart illustrating an example of speech processing performed by the speech processing device 1 according to the modified example 4. Note that a method is described in FIG. 12 in which a prediction residual signal obtained by linear prediction analysis of a speech waveform is used as an input.

In step S30, the extractor 210 performs linear prediction analysis on a speech signal input by the input unit 10 to obtain a prediction residual.

In step S31, the separator 240 separates the partial waveform of the prediction residual into a periodic component waveform and an aperiodic component waveform.

In step S32, the partial waveform processing unit 200 applies a linear prediction filter using a linear prediction coefficient obtained in step S30 to the periodic component waveform obtained by the separation to obtain a partial waveform of the periodic component.

In step S33, the partial waveform processing unit 200 applies a linear prediction filter using a linear prediction coefficient obtained in step S30 to the aperiodic component waveform obtained by the separation to obtain a partial waveform of the aperiodic component.

As a result of whitening the spectrum of a speech signal in advance as described above, the aperiodicity produced by time variation of the spectrum envelope can be removed to some extent and, particularly at a phoneme boundary or the like, the accuracy of separation can be increased.

Note that the processes in steps S32 and S33 may be omitted in a case where a periodic component and an aperiodic component of an acoustic signal are extracted. Although an example in which whitening of the spectrum is performed for a speech signal is described in the modified example 4, the whitening of the spectrum in step S31 may be applied to a partial waveform.

Modified Example 5

In addition, the functions of the speech processing device according to the embodiment described above may be implemented by executing speech processing programs.

In this case, the speech processing programs to be executed by the speech processing device according to the embodiment are stored in a computer-readable storage medium in a form that can be installed or in a form of a file that can be executed and provided as a computer program product. Furthermore, the speech processing programs to be executed by the speech processing device according to the embodiment may be embedded in a ROM or the like in advance and provided therefrom.

The speech processing programs to be executed by the speech processing device according to the embodiment have modular structures to implement the respective sections on a computer system. In an actual hardware configuration, a CPU reads recognition programs from an HDD or the like onto a RAM and executes the programs, whereby the respective sections are implemented on the computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech processing device comprising:

an input unit configured to input a speech signal;

a marking unit configured to assign a pitch mark representing a representative point in a fundamental period to the speech signal for each fundamental period;

an extractor configured to window a part of the speech signal and extract a partial waveform that is a speech waveform of the windowed part;

a calculator configured to perform frequency analysis of the partial waveform to calculate a frequency spectrum;

an estimator configured to generate an artificial waveform that is a waveform according to an interval between the pitch marks for each harmonic component having a frequency that is a predetermined multiple of a fundamental frequency of the speech signal and configured to estimate harmonic spectral features representing characteristics of the frequency spectrum of the harmonic component from each of the artificial waveforms; and a separator configured to separate the partial waveform into a periodic component produced from periodic vocal-fold vibration as an acoustic source and an aperiodic component produced from aperiodic acoustic sources other than the vocal-fold vibration by using the respective harmonic spectral features and the frequency spectrum of the partial waveform.

2. The speech processing device according to claim 1, wherein the extractor windows a part of the speech signal by using a predetermined analysis window, and the estimator estimates the harmonic spectral features by performing frequency analysis of a waveform extracted by windowing each of the artificial waveforms with an analysis window having the same length as the predetermined analysis window.

3. The speech processing device according to claim 1, wherein the marking unit further calculates a power value with respect to power for each fundamental period, and the estimator further generates the artificial waveform by using the power value.

4. The speech processing device according to claim 1, wherein the separator generates the frequency spectrum of the periodic component by calculating a linear sum of each of the harmonic spectral features.

5. The speech processing device according to claim 4, wherein the separator generates the frequency spectrum of the aperiodic component by subtracting the frequency spectrum of the periodic component from the frequency spectrum of the partial waveform in a complex spectrum range.

6. The speech processing device according to claim 5, wherein the separator generates the frequency spectrum of the periodic component by calculating an index relating to aperiodicity from the frequency spectrum of the aperiodic component and by calculating a linear sum of each of the harmonic spectral features so that the index relating to aperiodicity exceeds a predetermined threshold.

7. The speech processing device according to claim 6, wherein the index includes at least an index representing smoothness of the power in a frequency axis direction of the frequency spectrum of the aperiodic component.

8. The speech processing device according to claim 6, wherein the index includes at least an index representing randomness of phases in a frequency axis direction of the frequency spectrum of the aperiodic component.

9. The speech processing device according to claim wherein the analysis window used for windowing by the extractor is a Hanning window having a window width of 2 to 10 times a fundamental period.

10. The speech processing device according to claim 1, wherein the extractor performs whitening of a spectrum for the speech signal or the partial waveform.

11. A speech processing method comprising:

inputting a speech signal;

assigning a pitch mark representing a representative point in a fundamental period to the speech signal for each fundamental period;

windowing a part of the speech signal and extract a partial waveform that is a speech waveform of the windowed part;

performing frequency analysis of the partial waveform to calculate a frequency spectrum;

generating an artificial waveform that is a waveform according to an interval between the pitch marks for each harmonic component having a frequency that is a predetermined multiple of a fundamental frequency of the speech signal;

estimating harmonic spectral features representing characteristics of the frequency spectrum of the harmonic component from each of the artificial waveforms; and separating the partial waveform into a periodic component produced from periodic vocal-fold vibration as an acoustic source and an aperiodic component produced from aperiodic acoustic sources other than the vocal-fold vibration by using the respective harmonic spectral features and the frequency spectrum of the partial waveform.

12. A computer program product comprising a computer-readable medium having programmed instructions, wherein the instructions, when executed by a computer, cause the computer to execute:

inputting a speech signal;

assigning a pitch mark representing a representative point in a fundamental period to the speech signal for each fundamental period;

windowing a part of the speech signal and extract a partial waveform that is a speech waveform of the windowed part;

performing frequency analysis of the partial waveform to calculate a frequency spectrum;

generating an artificial waveform that is a waveform according to an interval between the pitch marks for each harmonic component having a frequency that is a predetermined multiple of a fundamental frequency of the speech signal;

estimating harmonic spectral features representing characteristics of the frequency spectrum of the harmonic component from each of the artificial waveforms; and separating the partial waveform into a periodic component produced from periodic vocal-fold vibration as an acoustic source and an aperiodic component produced from aperiodic acoustic sources other than the vocal-fold vibration by using the respective harmonic spectral features and the frequency spectrum of the partial waveform.

* * * * *